US005114527A

United States Patent [19]

Stern et al.

[11] Patent Number: 5,114,527

[45] Date of Patent: May 19, 1992

[54] DRYWALL TAPE APPLYING TOOL

[75] Inventors: Donald J. Stern; Jeff S. Heaton, both of Bellingham; James A. Tryon, Seattle, all of Wash.

[73] Assignee: DJS&T Limited Partnership, Bellingham, Wash.

[21] Appl. No.: 554,798

[22] Filed: Jul. 17, 1990

[51] Int. Cl.[5] ..... B44C 7/02

[52] U.S. Cl. ..... 156/575; 156/574; 156/577; 156/579; 118/413

[58] Field of Search ..... 156/71, 523, 524, 574, 156/575, 577, 579; 118/413, 421

[56] References Cited

U.S. PATENT DOCUMENTS 3,707,427 12/1972 Erickson ..... 156/575
3,880,701 4/1975 Moree ..... 156/526
4,003,781 1/1977 Holsten ..... 156/526
4,196,028 4/1980 Mills et al. ..... 156/71

*Primary Examiner*—David A. Simmons
*Assistant Examiner*—J. Sells
*Attorney, Agent, or Firm*—Hughes & Multer

[57] ABSTRACT

A dry wall tape applicator where the tape moves through a chamber containing a taping compound and out a dispensing opening to a seam defined by two drywall panels. The dispensing opening is formed in part by an adjustably mounted plate, the position of which is controlled by a rotatable knob having an eccentric actuating stud member engaging a slot of the plate. The plate is held within close tolerances in a slideway so that the dispensing opening defines an accurately controlled slot of uniform width. The bottom wall of the housing has a convex configuration so that when the tape is in close proximity to the bottom wall, there is a proper application of the taping compound to the tape.

22 Claims, 7 Drawing Sheets

DRYWALL TAPE APPLYING TOOL

The present invention relates to a tool to apply tape to a surface, and more particularly to a tool to apply a taping compound to a tape which is in turn applied to a surface, such as a seam location formed by two panels of drywall.

BACKGROUND ART

For the last several decades, there have been provided in the prior art various taping tools by which drywall tape can be applied to the seam formed by two drywall panels. The tape moves through a chamber defined by the tool and out a front dispensing opening. A taping compound (often called "mud") is positioned in the chamber so as to come into contact with one surface of the tape as it moves through the chamber.

For a number of reasons, it is sometimes desirable to vary the slot width of the forward dispensing opening or slot. One prior art method of doing this is to provide an adjustable plate which is mounted to a front part of the tool on a slant, and which is held in place by a pair of threaded studs and associated wing nuts and washers, so that this can be manually adjusted. However, precise adjustments for a plate such as this presents difficulties. This type of prior art applicator is discussed in more detail at the end of the specification of this patent application. Another consideration is that the component parts of a taping tool be arranged so that these can be easily assembled and disassembled for cleaning.

A search of the patent literature has disclosed a couple of patents of possible relevance to the present patent application. These are the following:

U.S. Pat. No. 4,003,781 (Holsten) discloses a taping tool where the tape to be applied extends through the chamber of a cement containing section and outwardly through the forward end thereof, to extend around a roller 70, which presses the tape into engagement with the wall board surface. There is an auxiliary tape cutting knife 46 which is mounted to the wall of the housing in a manner to be slideably movable to an extended position to cut the tape which is being applied.

U.S. Pat. No. 4,196,028 (Mills et al.) shows a taping tool where the tape moves through a chamber containing the "mud" M, and this tape passes out a forward end to be pressed by the main rollers 5 having peripheral teeth 9 against the wall surface. There is a flexible plate 49 secured to the front end of the floor member 31 and positioned so that the free end can be selectively moved by turning a screw member 51 to adjust the size of the tape outlet opening 29. The screw member 51 passes through a hole in the floor member 31 and has an exposed head portion 53 which can be manipulated to position the plate 49.

SUMMARY OF THE INVENTION

The taping tool of the present invention comprises a housing defining a chamber to contain a compound to be applied to a tape to be dispensed. The housing has a front dispensing opening through which the tape travels to be applied to a surface, such as a seam area between two drywall panels.

There is tape supply means to supply the tape to the chamber in a manner that the tape is able to move along a path of travel through said chamber to have the compound applied thereto and to exit through the dispensing opening. The tool has a first plate means defining one side of the dispensing opening, and it also has a second adjustably mounted plate means having a forward end defining a second side of the dispensing opening.

The housing comprises a close tolerance slideway means for the second plate means. The slideway means has slideway surface means having a close tolerance fit with longitudinally extending guide surface portions of said second plate means in a manner that said second plate means is caused to move along said lengthwise axis in close alignment therewith, and with any angular or wobbling motion being restrained within close tolerances by said slideway means.

There is adjusting means comprising a knob adjusting means mounted to the housing so as to be moveable to a plurality of adjusting positions. It further comprises actuating means positioned to be in engagement with the second plate means in a manner that movement of the adjusting knob means causes the actuating means to move the second plate means along the lengthwise axis within close tolerances so as to be able to precisely adjust a width dimension of the dispensing opening.

In the preferred form, the knob adjusting means is rotatably mounted to the housing about a first axis, and the actuating means is positioned about a second axis eccentric from the first axis in a manner that angular movement of the adjusting knob means causes the actuating means to move with a linear increment of travel along the lengthwise axis.

In a preferred form, the housing comprises an upper wall portion having a slope forwardly and downwardly toward the dispensing opening, and the second plate means fits against the top wall portion in parallel planar relationship therewith, so as to move along said lengthwise axis in a path parallel to said upper wall portion. More particularly, the guide surface portions of the second plate means engages adjacent inside surface portions of the housing in a close fitting relationship so as to align the second plate means within close tolerances.

In a specific form, the adjusting knob means comprises a knob rotatably mounted to the top wall portion, and the adjusting means extends through the top wall portion to engage slot means in the second plate means. Desirably the slot means extends transversely of the lengthwise axis of the second plate means.

Another feature of the present invention is that the adjusting knob means and the housing have interengaging notch/protrusion means extending in an arcuate path along a rotational path of travel of the adjusting knob means, whereby the adjusting knob means can be releasably held at various angular locations for adjustably locating the second plate means.

Also, the adjusting knob means has a position indicating means thereon, and the tool has locating indicia positioned on the housing to indicate position of the knob means. In a preferred form the indicia comprises an arcuately extending strip means having a tapering configuration, with a width of the taper corresponding to a slot width dimension of the dispensing opening so as to provide a visual indication of slot opening width.

Also, the tool comprises applicator wheel means mounted to the second plate means and positioned to engage tape dispensed through the dispensing opening. Thus, adjustment of position of the second plate means causes a corresponding adjustment of the position of the wheel applicator means.

Another feature of the present invention is that the slot means opens to a side edge of the second plate means, and the housing has a removeable side portion. Thus, the second plate means can be moved laterally from the housing with the slot means disengaging said actuating means.

Another feature of the present invention is that the housing has a lower wall having an inside surface that is convexly shaped. This is arranged so that when the tape is adjacent to the inside surface of the lower wall, the tape assumes a curved configuration corresponding to the convex curvature. Thus, when a small amount of compound is positioned adjacent to the inside surface of the bottom wall, a tension force on the tape provides a sufficient downward force on the tape to cause the tape to come into proper engagement with the compound adjacent to the inner surface of the bottom wall. Other features of the present invention from the following detailed description.

DESCRIPTION OF THE PREFERRED EMBODIMENT

Figure 1:
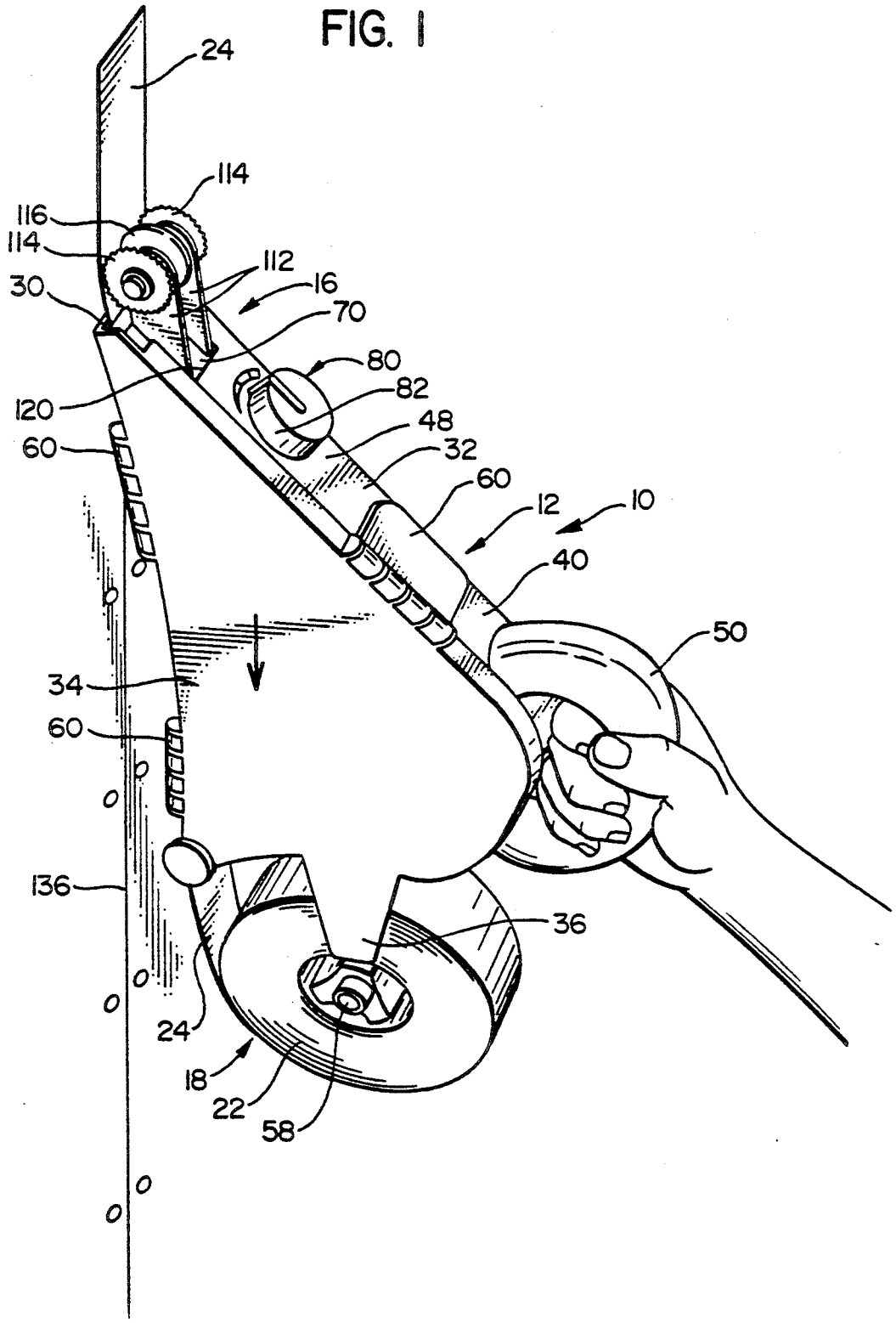
FIG. 1 is an isometric view of the present invention shown applying tape to a seam between two panels of dry wall, with the person grasping the upper U-shaped handle.

The tape applicator 10 of the present invention comprises a housing 12 which defines a chamber 14 (see FIG. 3) to contain a taping compound (i.e., the "mud"), and having a forward dispensing end 16 and a rear end 18. At the rear end of the housing 12, there is a mounting member 20 on which a roll 22 of dry wall tape 24 is mounted in a manner that the tape 24 from the roll is able to pass into the housing 12 through a rear opening 26 so as to be in contact with the mud 28 in the chamber 12, and to exit through a front slot-like opening 30. An important feature of the present invention is the arrangement by which the width or thickness dimension of the front opening 30 can be set within rather accurate limits, while maintaining the uniformity of the width of the opening 30, and this will be described later herein.

Figure 3:
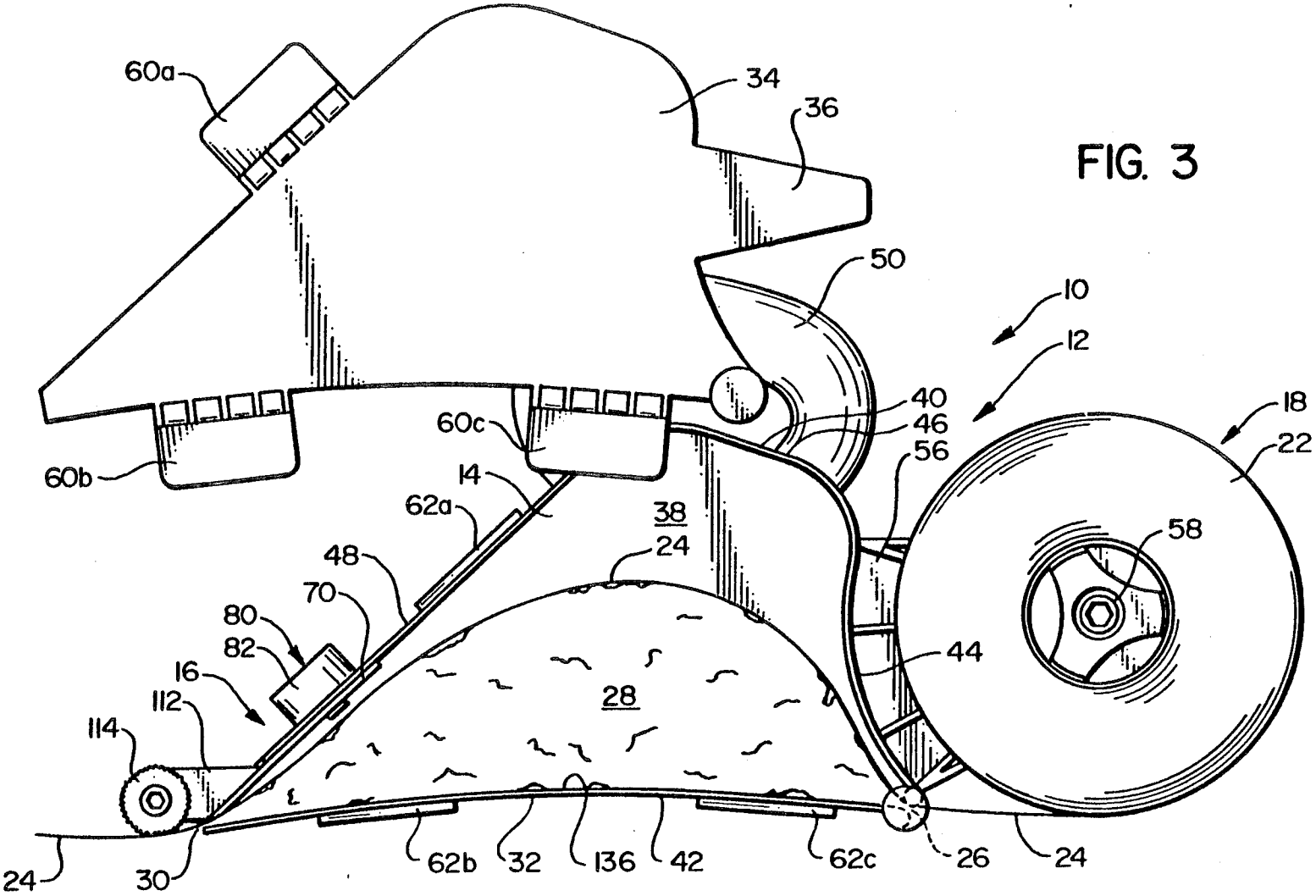
FIG. 3 is a side elevational view, showing the side cover removed from the main housing section.

The housing 12 comprises a main housing section 32 and a side cover 34 removably connected to the main housing section 32 so as to be able to be detached from the main housing section 32 to expose the mud containing chamber 13 (see FIG. 3). The cover has a rearwardly extending retaining finger 36 which holds the roll of tape 22 onto the mounting member 20 when the cover 34 is in its closed position.

The main housing section 32 has a side wall 38, a top wall 40, and a bottom wall 42. The top wall 40 has a back portion 44 to which the mounting member 20 is mounted, an upper top wall portion 46, and a forward top wall portion 48 which extends from the upper wall portion 46 forwardly and downwardly at a moderate slant.

Figure 2:
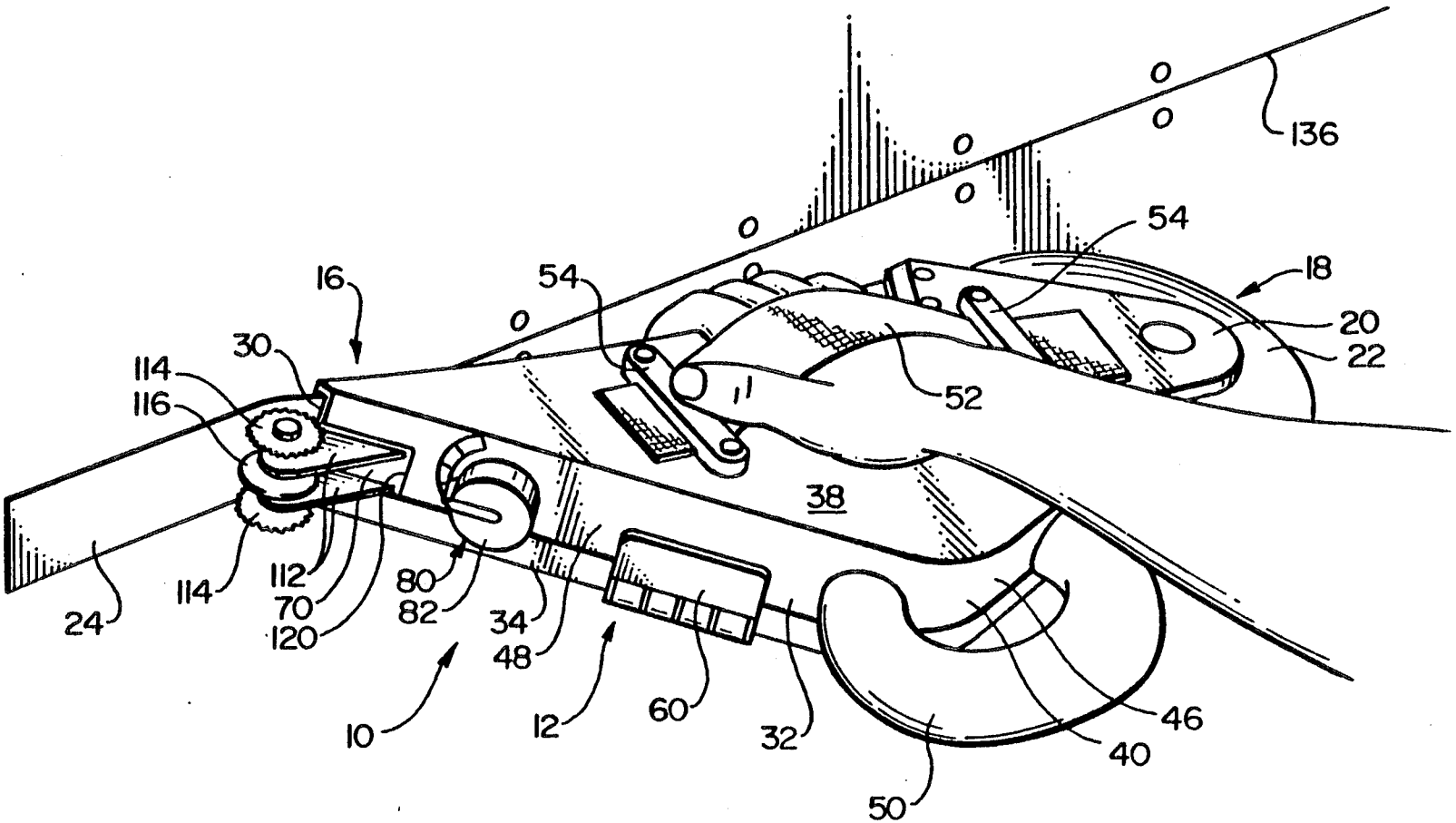
FIG. 2 is a second isometric view of the present invention showing the person grasping the applicator of the present invention by a side handle strap.

A U-shaped handle 50 is fixedly connected to the upper top wall section 46 and is positioned so that it can be manually grasped (see FIG. 1) to operate the applicator 10 in a tape applying operation. To provide an alternative method of operating the applicator 10, there is also provided a side strap 52 mounted to the outside of the housing side wall 38 by means of two brackets 54. (See FIG. 2.)

The aforementioned mounting member 20 is or may be of conventional design and as shown herein, it has a connecting portion 56 by which it is fixedly connected to the rear part of the housing sidewall 38 so as to extend rearwardly therefrom. At the rear end of the mounting member 20, there is a laterally extending mounting spindle 58 on which the roll of tape can be mounted.

The side cover 38 is conveniently mounted to the main housing section 32 by means of three connectors 60 (which may be of conventional design) that connect to matching outwardly extending flanges or lips 62 positioned along the free edge of the housing section 32 opposite to the position of the side wall 38. More specifically, one such lip **62*a* is mounted to the edge of the front top wall portion 48, while two other lip flange member 62*b* and 62*c* are mounted at forward and rear locations, respectively, at the edge of the bottom wall 42. The connectors 60 are given designations 60*a*, 60*b* and 60*c* to indicate their connection to similarly designated flanges 62*a*, 62*b*, and 62*c***.

It was indicated earlier herein that a significant feature of the present invention is the manner in which the width or thickness dimension of the forward slot opening 30 can be adjusted within rather close limits, while maintaining uniformity of the width along the length of the slot opening 30. To accomplish this, there is provided a first lower plate section or portion 64 which in the present invention is simply formed integrally with the housing section 32 as the forward portion of the housing bottom wall 42. The upper surface 66 of the forward end 68 of this forward plate portion defines the lower surface of the slot opening 30. (See FIGS. 5 and 9.)

To provide an upper surface defining the slot opening 30, there is an adjustable rectangularly shaped plate 70 having a forward slot defining end 72, with a downwardly facing slot defining surface 74 which is somewhat curved and positioned in large part generally parallel to the lower slot defining surface 66. The adjustable plate member 70 has a main mounting portion 76 which is positioned below, and in sliding contact with, the lower surface 78 of the top wall forward portion 48.

To precisely locate the position of the plate 70 along its lengthwise axis so as to accurately define the vertical width dimension of the dispensing slot 30, there is provided an adjusting mechanism generally designated 80. This adjusting mechanism 80 comprises a cylindrical adjusting knob 82 having a top circular surface 84 and a cylindrical side wall 86. The knob 82 is mounted for limited rotation to a short cylindrical flange 88 which is formed integrally with, and is upstanding from, the upper surface of the forward part of the forward top wall portion 48. More specifically, this flange 88 extends upwardly a very short distance and fits inside the lower inside surface portion of the cylindrical side wall 86.

The knob 82 is formed integrally with a downwardly extending cylindrical holding (member 90) which defines a cylindrical socket 91 which has a center axis 92 which is offset a short distance from a center axis of rotation 94 of the knob 82. Fitting in the socket 91 there is an actuating stud 96 which comprises a main cylindrical shank 98 having a removable friction fit within the cylindrical holder 90. At the lower end of the stud 96 there is a circular retaining head 100 having a diameter moderately larger than that of the shank 98. As will be described more fully later herein, the function of this stud 96 is to adjustably move the plate 70 forwardly and rearwardly in response to rotation of the adjusting knob 82 so as to change the width of the slot 30.

To accomplish the interaction between the stud 96 and the adjustable plate 70, first, the main mounting portion 76 of the plate 70 is formed with a laterally extending (slot 102) which opens at 104 at the side of the plate 70 adjacent to the housing side wall 38. This slot 102 has a lower width portion defined by the edge surfaces 106 having a width substantially the same as the actuating head 100, and has an upper slot defining portion which is stepped inwardly slightly to form two retaining lips 108 which extends over the head 100 so as to be in contact with the shank 98, and to engage the retaining head 100. Also, with reference to FIGS. 5–7 and 9–11, it can be seen that the forward portion of the forward top wall portion 48 is formed with a cut-out 110 to permit the stud 96 to move somewhat laterally as well as forward and rearwardly as the knob 82 is rotated.

It is believed to be readily apparent from the description thus far of the adjusting mechanism 80 that rotation of the knob 82 causes a linearly arcuate movement of the actuating stud 96 which in turn causes movement of the plate 70 along its lengthwise axis to either widen or narrow the dispensing slot 30. This will be described in more detail later herein under the description of the overall operation of the present invention.

Fixedly mounted to the lower forward front surface portion of the adjustable plate 70 are two laterally spaced, forwardly extending mounting arms 112 which in turn have rotatably mounted at their forward ends three roller wheels, namely two laterally outside wheels 114 (sometimes called "gears") having teeth about the periphery, and a central roller or wheel 116. The axis of rotation of these rollers or wheels 114/116 is indicated at 118. The upper forward top wall portion 48 is formed with a rectangular cut-out 120 to accommodate these arms 112 and permit the upward and rearward, and downward and forward, adjusting movement of the plate 70.

Figure 4:
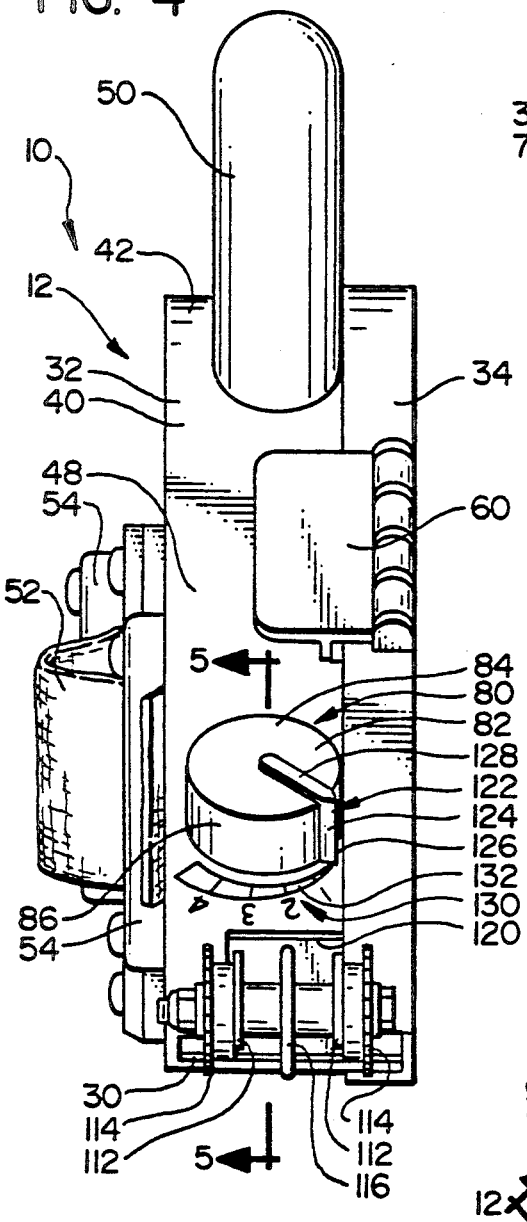
FIG. 4 is a front elevational view of the present invention, with the adjusting knob being set at a location for minimum slot width.
Figure 6:
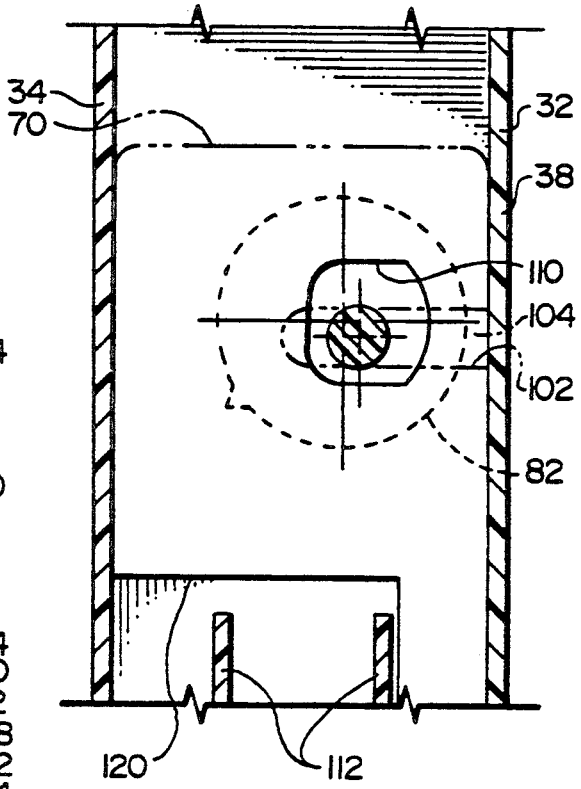
FIG. 6 is a sectional view taken along line 6—6 of FIG. 5.
Figure 6:
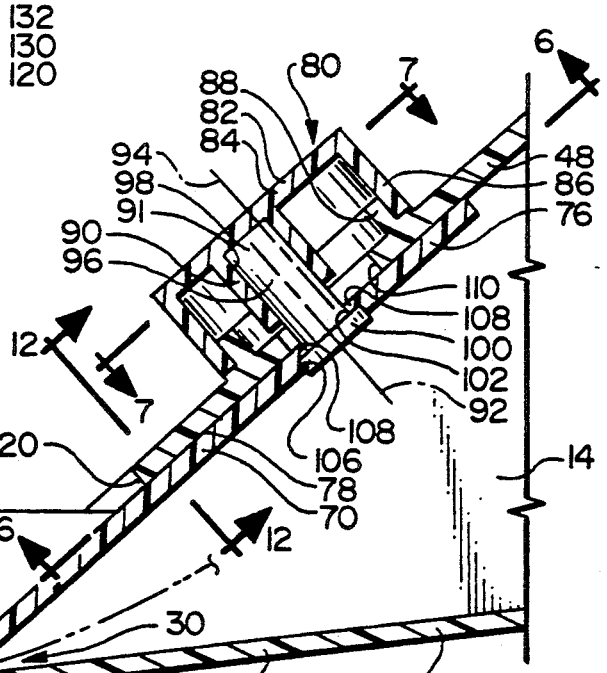
Figure 8:
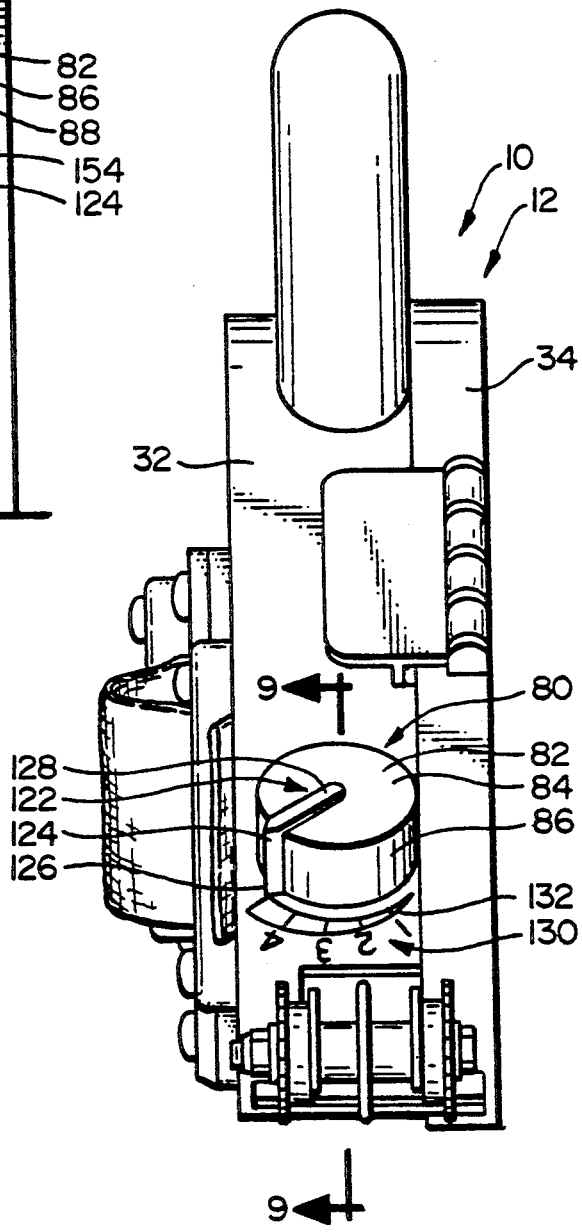
FIG. 8 is a front elevational view similar to that of FIG. 4, but showing the slot adjusting knob in its full open position.

Also, with reference particularly to FIGS. 4 and 8, it can be seen that the adjusting knob 80 has a position indicator 122 which comprises a wedge shaped portion 124 extending vertically along the knob sidewall 86 and having an outwardly indicating edge 126. In addition, the position indicator 122 comprises a radially extending raised portion 128 made integrally with the circular top wall 84 and connecting to the upper end of the portion 124.

Imprinted on the upper surface of the forward plate portion 48 just forwardly of the knob 82 is positioned slot width indicating means 130. More specifically, the slot with indicating means 130 comprises a series of numerical designations (which in this particular embodiment are the numerals 1 through 4) at circumferentially spaced locations adjacent to a forward arcuate portion of the knob 82. In addition, the slot width indicating means comprises an arcuately extending tapering strip 132 imprinted on the top surface of the forward plate portion 48, with this strip curving about the knob axis of rotation 94 and increasing in radial width dimension in a direction from the numeral one through the numeral four.

Figure 7:
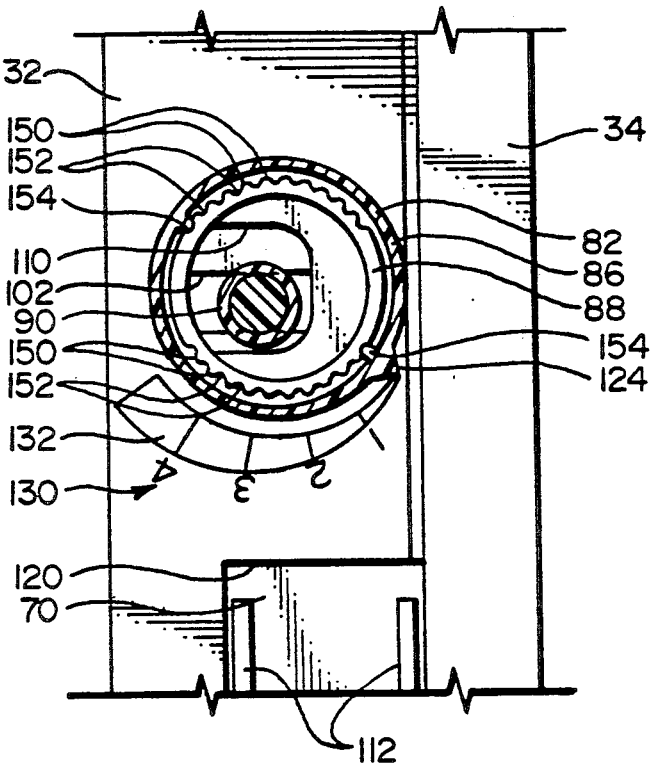
FIG. 7 is a sectional view taken along line 7—7 of FIG. 5.

When the knob 82 is rotated to the right hand position (as shown in FIGS. 4 and 7), the front dispensing opening 30 is at the minimum width or thickness dimension. On the other hand, when the knob 82 is rotated to the full left position, the dispensing slot 30 is at its maximum width or thickness dimension.

Figure 12:
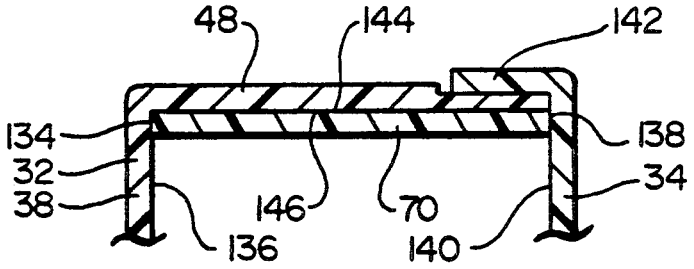
FIG. 12 is a sectional view taken along line 12—12 of FIG. 5.

Reference is now made to FIG. 12 which illustrates in transverse cross section the adjusting plate 70. It can be seen that the left edge 134 of the plate 70 fits against the adjacent portion of the inside surface 136 of the housing side wall 38. Further, the right edge 138 of the plate 70 fits snugly against an adjacent portion of the inside surface 140 of the cover plate 34. Also, the cover plate 34 has a peripheral flange 142 which fits around the adjacent edge portions of the housing section 32. The upper surface 144 of the plate 70 fits against the downwardly facing inner surface 146 of the top forward wall portion 48. Thus, it can be appreciated that the two adjacent portions of the side surfaces 136 and 140 and also the downwardly facing surface 146 form a slideway for the plate 70 of rather close tolerances so that there is substantially no side to side wobbling or skewing of the plate, and so that there is substantially no slack nor angular wobble in a vertical direction.

To describe the operation of the present invention, let it be assumed that the dispensing apparatus 10 is fully assembled, but with no mud 28 within the chamber 14. the fasteners 60 are moved to the release position, and the cover 34 is removed, as shown in FIG. 3. The tape roll 22 which is mounted to the rear end of the apparatus 10 has the tape 24 unrolled therefrom to be threaded through the opening 26, through the chamber 14 and out the dispensing end 30. The mud 28 is deposited in the chamber 30 at a location between the bottom wall 42, and the tape 24, the tape 24 being positioned upwardly toward the top wall 40 so that a sufficiently large quantity of the mud 28 can be inserted into the chamber 38.

The cover 34 is then placed onto the main housing section 32, with the fasteners 60 being secured to maintain the cover 34 in place. It is assumed that the adjusting plate 70 has already been mounted to the main housing section 32 as shown in the accompanying drawings.

Figure 5:
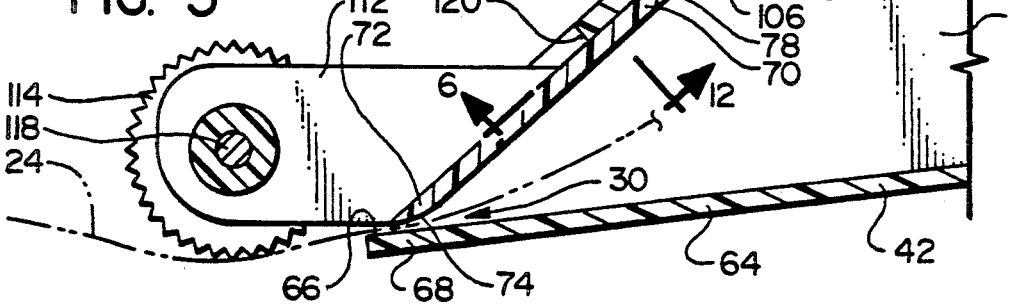
FIG. 5 is a sectional view taken along line 5—5 of FIG. 4.

The next step is to check the position of the adjusting knob 82, as shown by the position indicator 122 on the knob 82. As indicated previously, in the position of FIG. 7, the adjusting knob 82 is positioned so that the adjusting plate 70 is at its furthest forward and downward position (as shown in FIG. 5) so that the width or thickness of the slot 30 is at the minimum. However, when the knob 82 is rotated to the full left position (as in FIG. 11), the slot 30 is at the maximum width dimension.

To review how the adjustment of the plate 70 is accomplished, as indicated previously with regard to FIG. 12, the plate 70 has a close tolerance fit within the housing section 32 and the cover 34 and is held snugly against the downwardly facing surface 146 by the head 100 of the actuating stud 96. Thus, as the plate 70 slides a short distance along its lengthwise axis upwardly and rearwardly to a more open position for the slot 30, or downwardly and forwardly to lessen the width dimension of the slot 30, the slot defining surface 74 of the forward end 72 of the plate 70 remains accurately and uniformly aligned across the other slot defining surface 66 within very close tolerances.

Figure 9:
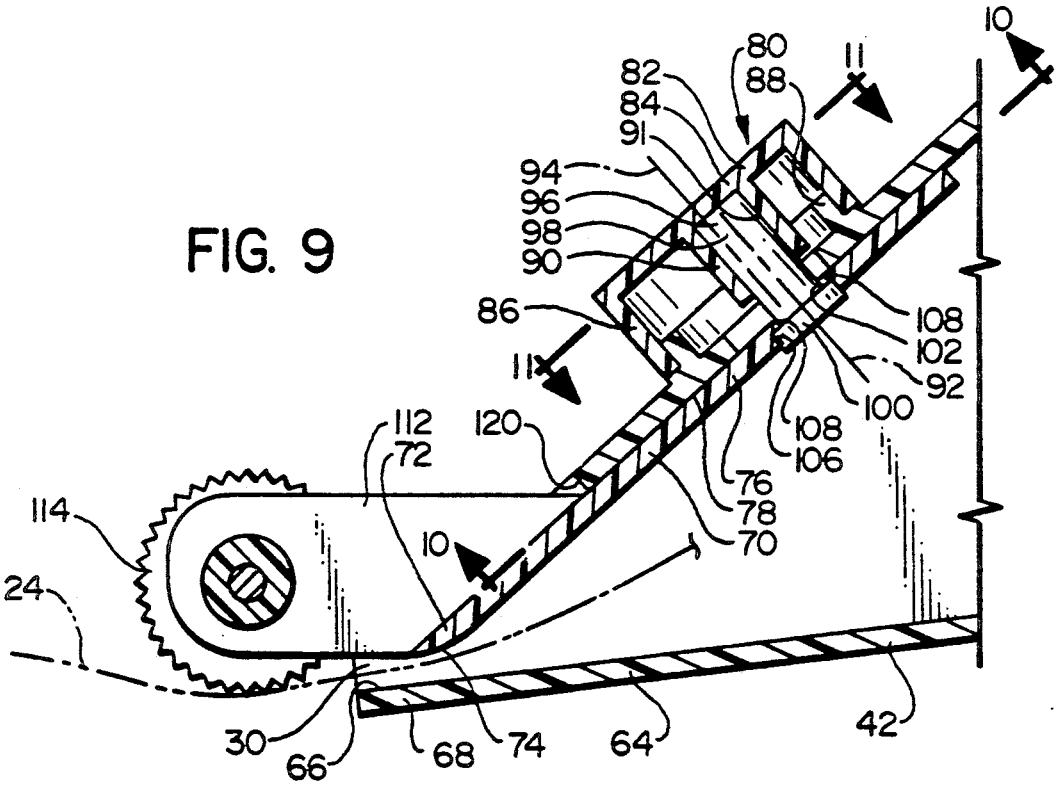
FIG. 9 is a sectional view similar to FIG. 5, but taken along line 9—9 of FIG. 8.
Figure 10:
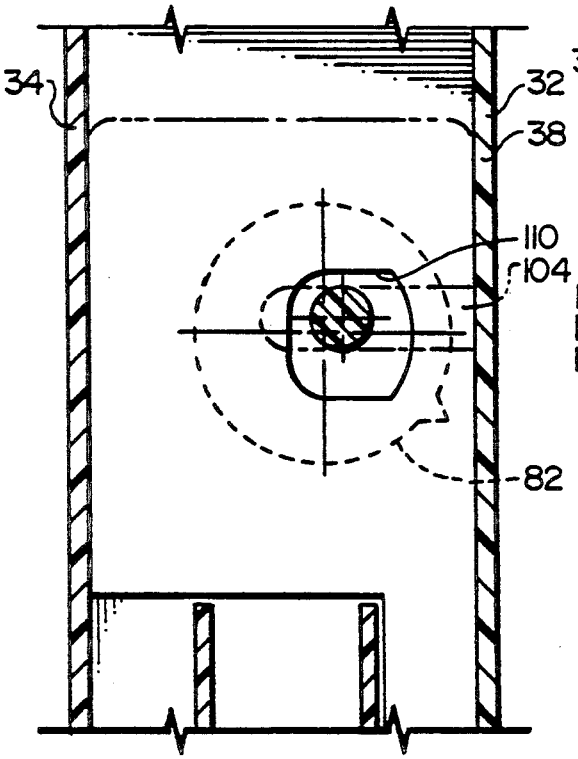
FIG. 10 is a sectional view similar to FIG. 6, but taken along line 10—10 of FIG. 9.
Figure 11:
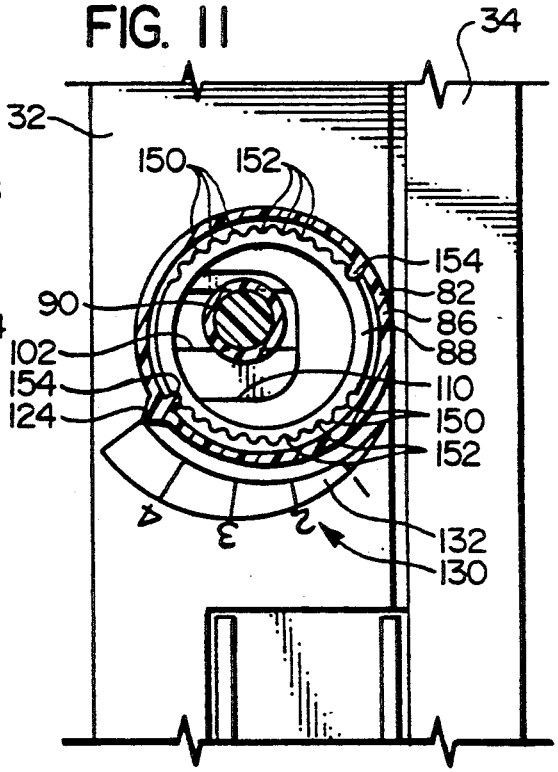
FIG. 11 is a view similar to FIG. 7, but taken along line 11—11 of the present invention.

Also, as indicated previously, the knob 82 has the actuating stud 96 mounted thereto about the eccentric axis 92 so that rotational movement of the knob 82 causes the actuating stud 96 to have a linear increment of travel parallel to the forward to rear lengthwise axis of the plate 70. This can be seen more easily by making reference first to FIGS. 4 through 7 which show the knob 82 in the minimum slot width position, and the actuating stud 96 is at its most forward location, as evidenced b the axis 92 of the stud 96 being positioned forwardly of the knob axis of rotation 94. Then, as indicated in FIGS. 8 through 11, when the knob 82 is moved to its furthest open position, the eccentric movement of the actuating stud 96 is such that the eccentric axis 92 is positioned rearwardly of the adjusting knob center axis 94 so that the adjusting plate 70 is at a more upward and rearward position. In this position, as can be seen in FIG. 9, the forward dispensing slot or opening 30 is substantially wider then in the position of FIG. 5.

With the width of the slot 30 being properly set by the knob 82, the taping apparatus 10 can then be used to apply tape in much the same manner that most taping tools of this general type are used. More specifically, the forward end of the tape 24 is positioned adjacent the wheels or rollers 114 and 116, the apparatus 10 is positioned to press the tape 24 against the drywall seam 136 in the manner shown in either FIGS. 1 or 2, and the apparatus 10 is moved along the seam to apply the tape 24 which unrolls from the roll 22. Since the manner in which the tape 24 moves through the mud containing chamber and out the dispensing slot to be applied to the seam 136 is well known in the prior art, this will not be described in detail herein.

Another advantageous feature of the present invention will now be described with reference to FIG. 3. It can be seen that the upper surface of the bottom wall 42 has a moderately convex curve. The effect of this is that as the taping compound or mud 28 continues to be applied to the tape 24 as it exits through the dispensing open 30, the dwindling supply of the mud 28 in the chamber 38 finally becomes so small that there is only a small amount of such mud or taping compound 28 positioned just above the bottom wall surface 136. With the moderate upward curvature of the wall 136, the tension applied to the tape 24 causes it to press downwardly to a moderate extent against the curved bottom wall surface 136 so that the last small amount of taping compound or mud 28 becomes applied to the tape 24.

To describe another feature of the present invention, it will be noted that the cylindrical flange 88 has two arcuate diametrically opposed outwardly facing peripheral portions moderately longer than ninety degrees, formed with a series of circumferentially spaced protrusions 150 forming uniformly spaced notches 152 therebetween. Further, the inside surface of the lower edge portion of the knob sidewall 86 has a pair of radially inwardly extending, diametrically opposed protruding portions 154 which snap into engagement with the recesses 152. Thus, the knob 82 can be rotated through short increments of travel, with the engagement of the protrusions 154 in the notches 152 providing secure positioning of the knob 82 at any one location.

Another valuable feature of the present invention is that it can easily be disassembled for cleaning, and then reassembled. As indicated previously, the cover 34 can easily be removed by operation of the fasteners 60. With the cover 34 so removed, the adjusting plate 70 can be removed by simply sliding it outwardly toward the open side of the main housing section 32. Since the slot 102 in the adjusting plate 70 opens at 104, the plate 70 is simply slipped out of engagement with the actuating stud 96. After disengagement of the plate 70, the knob 82 with the stud 96 can be pulled away from the forward top wall portion 48. This permits easy cleaning of the component parts, and after cleaning, these can be easily assembled.

Figure 13:
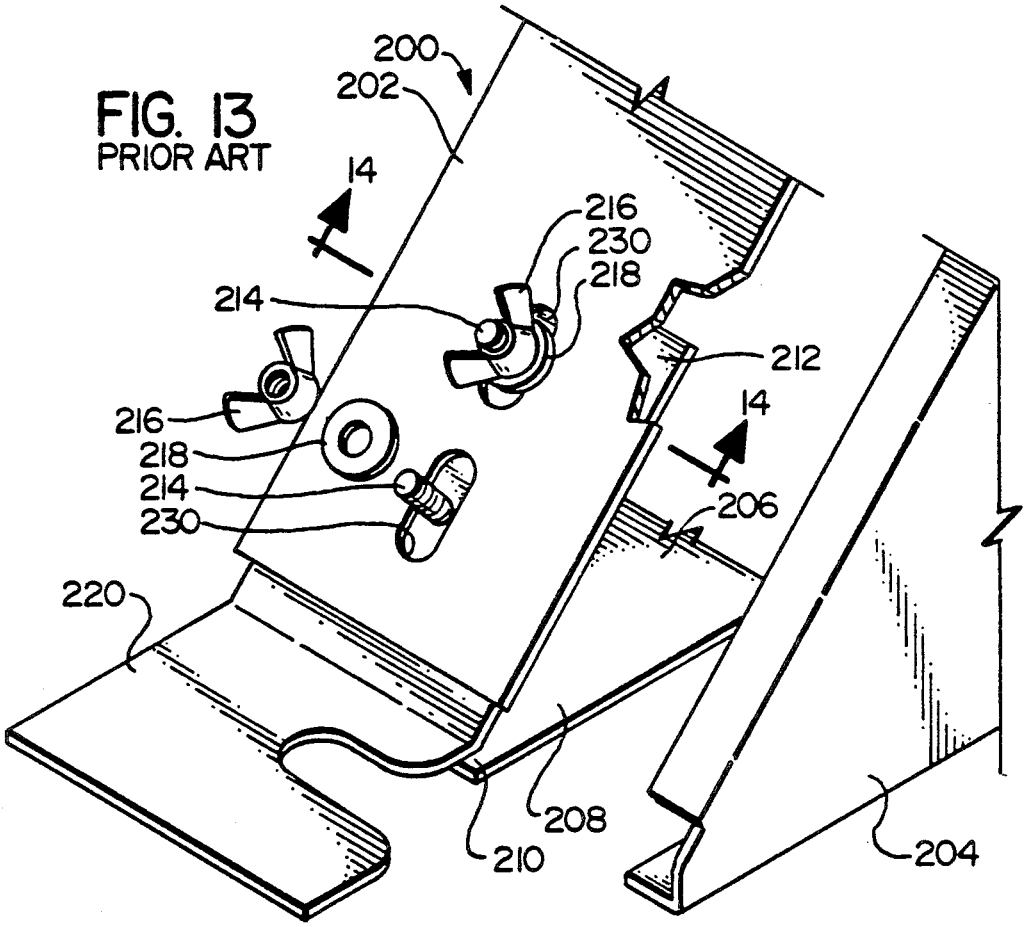
FIG. 13 PRIOR ART
FIG. 13 is an isometric view of a portion of a commercially available prior art taping tool having an adjustable plate defining a slot opening through which the cement is dispensed.
Figure 14:
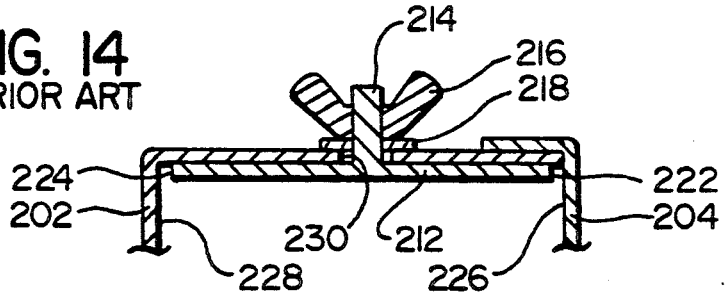
FIG. 14 PRIOR ART
FIG. 14 is a sectional view taken along line 14—14 of FIG. 13.

With the foregoing description of the present invention in mind, attention is now directed to FIGS. 13 and 14 which illustrate a front portion of a prior art taping applicator 20 which is now commercially available, and which has an adjusting plate to vary the width of the dispensing slot. It can be seen in FIG. 13 that this apparatus 200 has a first housing section 202 with a removable side cover 204. The housing section 202 defines a mud containing chamber 206, and there is a lower plate portion 208 which defines the lower surface of a dispensing slot 210.

An adjustable mounting plate 212 is positioned just beneath the forward plate portion 202, and there are fixedly secured to the plate 212 a pair of threaded studs 214, onto which are threaded a pair of wing nuts 216. A pair of washers 218 are located between the wing nuts 216 and the upper edge portions of the top forward wall portion 202. The lower front edge of the adjusting plate 212 has a forwardly extending plate portion 220.

It can be seen that the position of the plate 212 can be varied to change the width dimension of the dispensing slot 210. This is accomplished by loosening the wing nuts 216, and then manually adjusting the location of the mounting plate 212. Then the wing nuts 216 can be screwed down into place.

As shown in FIG. 14, the plate 212 has two edge portions 222 and 224, one of which is spaced inwardly from the adjacent portion of the inside surface 226 of the cover 204 and the other spaced inwardly from the adjacent portion of the inside surface 228. Further, it can be seen that the studs 214 extend upwardly through longitudinally extending slots 230 which have a width dimension a fair amount larger than the diameters of the two studs 214. It is readily apparent, therefore, that the plate 212 can be moved not only longitudinally (i.e. in a forward to rear direction), but also the angular position of this plate 212 can be shifted. Thus, in order to precisely position the plate 212 to have the desired width and uniformity of this slot 210, the plate 212 must be carefully positioned and then held at that position while the wing nuts 216 are tightened.

In contrast to the prior art device shown in FIGS. 13 and 14, with the present invention 10, the adjusting plate 70 is positioned reliably so that the dispensing slot 30 always has a uniform width within close tolerances. Further, the adjustment of the plate 70 to vary the width of the slot 30 is a simple one handed operation which can be accomplished with precision by rotating the knob 82 to the precisely indicated position. The indicating means 122 is provided so as to give not only numerical values, but a visual representation indicating the width of the slot 30.

It is to be understood various modifications can be made without departing from the basic teachings of the present invention.

What is claimed is:

1. A taping tool comprising:

a. a housing having a forward end and a rear end, and defining a chamber to contain a compound to be applied to a tape to be dispensed;

b. said tool having a front dispensing opening leading from said chamber;

c. tape supply means to supply tape to said chamber in a manner that said tape is able to move along a path of travel through said chamber to have the compound applied thereto and to exit through said dispensing opening;

d. said tool having a first plate means defining one side of said dispensing opening;

e. said tool having a second adjustably mounted plate means having a lengthwise axis and having a forward end defining a second side of said dispensing opening;

f. said housing comprising a close tolerance slideway means for said second plate means, said slideway means having slideway surface means having a close tolerance fit with longitudinally extending guide surface portions of said second plate means in a manner that said second plate means is caused to move along said lengthwise axis, with any angular or wobbling motion being restrained within close tolerances by said slideway means;

g. adjusting means comprising adjusting knob means mounted to said tool so as to be movable to a plurality of adjusting positions, and comprising actuating means positioned to be in engagement with said second plate means, in a manner that movement of said adjusting knob means causes said actuating means to move said second plate means to move along said lengthwise axis within close tolerances so as to be able to precisely adjust a width dimension of said dispensing opening;

h. said adjusting knob means being mounted to said housing rotatably so as to be movable to a plurality of angularly spaced adjusting positions about a first axis, said actuating means being positioned at a second axis spaced from said first axis in a manner that rotation of said adjusting knob means causes an increment of linear movement of said actuating means along said lengthwise axis.

2. The tool as recited in claim 1, wherein said housing comprises an upper wall portion having a slope forwardly and downwardly toward said dispensing opening, and said second plate means fits against said upper wall portion in parallel planar relationship therewith, so as to move along said lengthwise axis in a path parallel to said upper wall portion.

3. The tool as recited in claim 2, wherein said guide surface portions of said second plate means engage adjacent inside surface portions of said housing in a close fitting relationship so as to align said second plate means within close tolerances.

4. The tool as recited in claim 1, wherein said knob means comprises a knob rotatably mounted to said top wall portion, and said actuating means extends through said upper wall portion to engage slot means in said second plate means.

5. The tool as recited in claim 4, wherein said slot means extends transversely of the lengthwise axis of said second plate means, and said actuating means comprises actuating stud means eccentrically positioned relative to and connected to said knob in a manner that rotation of said knob causes an increment of linear travel of said actuating means along said lengthwise axis to cause adjusting movement of said second plate means along said lengthwise axis, said stud means engaging said slot means.

6. The tool as recited in claim 1, wherein said knob means and said housing have interengaging notch/protrusion means extending in an arcuate path along a rotational path of travel of said knob means, whereby said knob can be releasably held at various angular locations for adjustably locating said second plate means at various lengthwise positions.

7. The tool as recited in claim 6, wherein said knob has a position indicating means on said knob, and said tool has locating indicia positioned on said housing to indicate position of said knob.

8. The tool as recited in claim 7, wherein said indicia comprises an arcuately extending strip means, having a tapering configuration, with a width dimension of said taper corresponding to slot width dimension of said dispensing opening so as to provide a visual indication of slot opening width.

9. The tool as recited in claim 4, wherein the slot means opens to a side edge of said second plate means, and said housing has a removeable side portion, whereby said second plate means can be moved laterally from said housing with said slot means disengaging said actuating means.

10. The tool as recited in claim 1, wherein said adjusting knob means and said housing have interengaging notch/protrusion means extending in an arcuate path along a rotational path of travel of said adjusting knob means, whereby said adjusting knob means can be releasably held at various angular locations for adjustably locating said second plate means at various lengthwise positions.

11. The tool as recited in claim 10, wherein said adjusting knob means has a position indicating means on said knob means, and said tool has locating indicia positioned on said housing to indicate position of said knob means.

12. The tool as recited in claim 11, wherein said indicia comprises an arcuately extending strip means, having a tapering configuration, with a width dimension of said taper corresponding to slot width dimension of said dispensing opening so as to provide visual indication of slot opening width.

13. The tool as recited in claim 2, further comprising applicator wheel means mounted to said second plate means and positioned to engage tape dispensed through said dispensing opening, whereby adjustment of position of said second plate means causes a corresponding adjustment of position of said wheel applicator means.

14. A taping tool comprising:

a. a housing defining a chamber to contain a compound to be applied to the tape and having a top wall, a bottom wall, and a front discharge opening;

b. tape supply means to supply tape to said chamber in a manner that said tape is able extend toward an upper part of said chamber to said dispensing opening, with the compound positioned in the chamber between said tape and said lower wall;

c. said bottom wall having an inside surface convexly shaped, whereby when said tape is adjacent to said inside surface, said tape assumes a curved configuration corresponding to convex curvature of said inside surface, whereby when a small amount of the compound is positioned adjacent to the inside surface of the bottom wall, a tension force on the tape provides a sufficient downward force on the tape to cause the tape to come into proper engagement with the compound adjacent to the inner surface of the bottom wall.

15. A taping tool comprising:

a. a housing having a forward end and a rear end, and defining a chamber to contain a compound to be applied to a tape to be dispensed;

b. said tool having a front dispensing opening leading from said chamber;

c. tape supply means to supply tape to said chamber in a manner that said tape is able to move along a path of travel through said chamber to have the compound applied thereto and to exit through said dispensing opening;

d. said tool having a first plate means defining one side of said dispensing opening;

e. said tool having a second adjustably mounted plate means having a lengthwise axis and having a forward end defining a second side of said dispensing opening;

f. said housing comprising a close tolerance slideway means for said second plate means, said slideway means having slideway surface means having a close tolerance fit with longitudinally extending guide surface portions of said second plate means in a manner that said second plate means is caused to move along said lengthwise axis, with any angular or wobbling motion being restrained within close tolerances by said slideway means;

g. adjusting means comprising adjusting knob means mounted to said tool so as to be movable to a plurality of adjusting positions, and comprising actuating means positioned to be in engagement with said second plate means, in a manner that movement of said adjusting knob means causes said actuating means to move said second plate means to move along said lengthwise axis within close tolerances so as to be able to precisely adjust a width dimension of said dispensing opening;

h. applicator wheel means mounted to said second plate means and positioned to engage tape dispensed through said dispensing opening, whereby adjustment of position of said second plate means causes a corresponding adjustment of position of said wheel applicator means.

16. A taping tool comprising:

a. a housing having a forward end and a rear end, and defining a chamber to contain a compound to be applied to a tape to be dispensed;

b. said tool having a front dispensing opening leading from said chamber;

c. tape supply means to supply tape to said chamber in a manner that said tape is able to move along a path of travel through said chamber to have the compound applied thereto and to exit through said dispensing opening;

d. said tool having a first plate means defining one side of said dispensing opening;

e. said tool having a second adjustably mounted plate means having a lengthwise axis and having a forward end defining a second side of said dispensing opening;

f. said housing comprising a close tolerance slideway means for said second plate means, said slideway means having slideway surface means having a close tolerance fit with longitudinally extending guide surface portions of said second plate means in a manner that said second plate means is caused to move along said lengthwise axis, with any angular or wobbling motion being restrained within close tolerances by said slideway means;

g. adjusting means comprising adjusting knob means mounted to said tool so as to be movable to a plurality of adjusting positions, and comprising actuating means positioned to be in engagement with said second plate means, in a manner that movement of said adjusting knob means causes said actuating means to move said second plate means to move along said lengthwise axis within close tolerances so as to be able to precisely adjust a width dimension of said dispensing opening;

h. said actuating knob means comprising a knob rotatably mounted to said housing for rotation about a first axis, and said actuating means comprises an actuating stud mounted to said knob about a second axis spaced from said first axis, said actuating stud means extending into a slot formed in said second plate means, in a manner that rotation of said knob causes said stud means to move in said slot to cause adjusting movement of said second plate means about said lengthwise axis, said slot being open laterally in a manner that said second plate means can be moved out of engagement with said stud means, said housing comprising a removable cover portion which permits said second plate means to be removed from said tool.

17. A taping tool comprising:

a. a housing having a forward end and a rear end, and defining a chamber to contain a compound to be applied to a tape to be dispensed;

b. said tool having a front dispensing opening leading from said chamber;

c. tape supply means to supply tape to said chamber in a manner that said tape is able to move along a path of travel through said chamber to have the compound applied thereto and to exit through said dispensing opening;

d. said tool having a first plate means defining one side of said dispensing opening;

e. said tool having a second adjustably mounted plate means having a lengthwise axis and having a forward end defining a second side of said dispensing opening;

f. said housing comprising a close tolerance slideway means for said second plate means, said slideway means having slideway surface means having a close tolerance fit with longitudinally extending guide surface portions of said second plate means in a manner that said second plate means is caused to move along said lengthwise axis, with any angular or wobbling motion being restrained within close tolerances by said slideway means;

g. adjusting means comprising adjusting knob means mounted to said tool so as to be movable to a plurality of adjusting positions, and comprising actuating means positioned to be in engagement with said second plate means, in a manner that movement of said adjusting knob means causes said actuating means to move said second plate means to move along said lengthwise axis within close tolerances so as to be able to precisely adjust a width dimension of said dispensing opening;

h. said housing having a bottom wall having an inside surface convexly shaped, whereby when said tape is adjacent to said inside surface, said tape assumes a curved configuration corresponding to convex curvature of said inside surface, whereby when a small amount of the compound is positioned adjacent to the inside surface of the bottom wall, a tension force on the tape provides a sufficient downward force on the tape to cause the tape to come into proper engagement with the compound adjacent to the inner surface of the bottom wall.

18. A taping tool comprising:

a. a housing having a forward end and a rear end, and defining a chamber to contain a compound to be applied to a tape to be dispensed;

b. said tool having a front dispensing opening leading from said chamber;

c. tape supply means to supply tape to said chamber in a manner that said tape is able to move along a path of travel through said chamber to have the compound applied thereto and to exit through said dispensing opening;

d. said tool having a first plate means defining one side of said dispensing opening;

e. said tool having a second adjustably mounted plate means having a lengthwise axis and having a forward end defining a second side of said dispensing opening;

f. said housing comprising a close tolerance slideway means for said second plate means, said slideway means having slideway surface means having a close tolerance fit with longitudinally extending guide surface portions of said second plate means in a manner that said second plate means is caused to move along said lengthwise axis, with any angular or wobbling motion being restrained within close tolerances by said slideway means;

g. adjusting means comprising adjusting knob means mounted to said tool so as to be movable to a plurality of adjusting positions, and comprising actuating stud means connected to said knob means to be movable therewith, and positioned to be in engagement with slot means in said second plate means, in a manner that movement of said adjusting knob means causes said actuating stud means to move in said slot means to move said second plate means to move along said lengthwise axis within close tolerances so as to be able to precisely adjust a width dimension of said dispensing opening.

19. The tool as recited in claim 18, wherein said knob means comprises a knob rotatably mounted to said top wall portion, and said actuating means extends through said upper wall portion to engage slot means in said second plate means.

20. The tool as recited in claim 18, wherein said knob means and said housing have interengaging notch/protrusion means extending along a path of travel of said knob means, whereby said knob means can be releasably held at various locations for adjustably locating said second plate means at various lengthwise positions.

21. The tool as recited in claim 18 wherein said knob means and said housing have indicating means by which position of the knob means relative to said housing is indicated.

22. The tool as recited in claim 18, further comprising applicator wheel means mounted to said second plate means and positioned to engage tape dispensed through said dispensing opening, whereby adjustment of position of said second plate means causes a corresponding adjustment of position of said wheel applicator means.

* * * * *